United States Patent [19]

Treczka

[11] 4,297,658

[45] Oct. 27, 1981

[54] 3DB WAVEGUIDE DIRECTIONAL COUPLER

[75] Inventor: Leo Treczka, Munich, Fed. Rep. of Germany

[73] Assignee: Spinner GmbH Elektrotechnische Fabrik, Munich, Fed. Rep. of Germany

[21] Appl. No.: 117,472

[22] Filed: Feb. 1, 1980

[30] Foreign Application Priority Data

Feb. 2, 1979 [DE] Fed. Rep. of Germany ..... 2904054

[51] Int. Cl.[3] ..... H01P 5/18

[52] U.S. Cl. ..... 333/113; 333/125

[58] Field of Search ..... 333/113

[56] References Cited

U.S. PATENT DOCUMENTS

| | | | |
|---|---|---|---|
| 2,519,734 | 8/1950 | Bethe | 333/113 |
| 2,866,166 | 12/1958 | Zaleski | 333/113 |
| 2,876,421 | 3/1959 | Riblet | 333/113 |

*Primary Examiner*—Paul L. Gensler

*Attorney, Agent, or Firm*—Ostrolenk, Faber, Gerb & Soffen

[57] ABSTRACT

A 3dB waveguide directional coupler for coupling two rectangular waveguides of the same dimensions and having parallel longitudinal axes is disclosed. The waveguides to be coupled are joined so that one of the wider side walls of the first waveguide adjoins one of the wider side walls of the second waveguide. The interiors of the two waveguides communicate via an aperture in the adjoining side walls. When energy is input from one end of the first waveguide toward the aperture, virtually all of it is transmitted to the second wave guide, part of the transmitted energy traveling away from the aperture in each direction along the longitudinal axis of the second waveguide. This is preferably achieved by providing a waveguide system in the aperture oriented perpendicular to the longitudinal axes of the first and second waveguides. The waveguide system in the aperture comprises a web plate perpendicular to the longitudinal axes of the first and second waveguides, and first and second conductive plates parallel to the web plate and spaced therefrom by the minimum dimension of the first and second waveguides.

11 Claims, 5 Drawing Figures

3DB WAVEGUIDE DIRECTIONAL COUPLER

BACKGROUND OF THE INVENTION

The invention relates to a 3dB waveguide directional coupler of the type in which two coupling slits or windows are spaced apart in a wall which is shared in common by two rectangular waveguides, the length of the common wall being the larger dimension of the cross-section of both rectangular waveguides. Such waveguide couplers are used to divide the total energy into equal part energies, a further division being possible by series arrangement of a plurality of waveguide couplers. The energy flow of such directional couplers is also reversible so that part energies can be combined. Such energy division or combination frequently is necessary when several transmitters of the same power and frequency are to be connected to a common load, generally an antenna.

In the known 3dB waveguide directional couplers the coupling slits or windows are disposed with the spacing $\lambda H/4$ in the common or adjacent wide sides of the two waveguides, i.e. the coupling plane extended in the plane of said wide sides. The entire energy is then divided into a portion which is propagated over the same waveguide and a second portion which is propagated as a sum of the coupled-out fractions in the same direction in the adjacent waveguide. The portion of the adjacent waveguide next to the input of the waveguide receives the difference of the values and consequently the coupler is decoupled at this point.

This means that on connecting together the energy is supplied to the two adjacent terminals of the two waveguides and the entire energy must be carried off at the opposite end. This results in difficulties when connecting together transmitters arranged adjacent each other in a row because the supply to the directional couplers requires deviating lines which result in undesirably long leads.

The invention is thus based on the problem of providing a 3dB waveguide directional coupler of the aforementioned type which in a compact space permits connection of a plurality of transmitters arranged adjacent each other in a row.

SUMMARY OF THE INVENTION

This problem is solved by disposing a short section of an additional rectangular waveguide in an aperture in the common wall (the wider wall) of the waveguides to be coupled. The additional waveguide comprises a web and two conductive plates disposed in the aperture. The web is disposed in the aperture perpendicular to the longitudinal direction of extension of the waveguides, i.e. perpendicular to the direction of propagation in the first and second waveguides. The conductive plates are disposed at each end of the aperture, parallel to the web. This makes it possible to dispose the coupler between every two transmitters because the transmission energy can be supplied from both sides of the coupler, enabling in simple manner in particular the connection of four transmitters by means of three couplers. Each of two couplers is disposed between a respective pair of transmitters to couple their outputs and an additional coupler is fed at its two ends from the other two couplers and connected to the load.

According to a preferred embodiment of the invention this arrangement is achieved by disposing the coupling plane, which in known couplers extends parallel to the waveguide axes, perpendicular thereto, so that two waveguide portions extending perpendicularly between the two waveguides of the coupler are formed between which the coupler slits can be disposed, thus producing the desired energy division.

Other objects and features of the invention will be apparent from the following description and the accompanying drawings.

BRIEF DESCRIPTION OF THE DRAWINGS

The invention will be described hereinafter with the aid of an example of a preferred embodiment illustrated in the drawings, wherein.

DETAILED DESCRIPTION OF THE PREFERRED EMBODIMENT

The waveguide coupler comprises two rectangular waveguides 10 and 12 engaging each other at their wide sides. In the central portion of the coupler there is a coupling means in the form of coupling slits or windows via which the energy is coupled into or out of the one waveguide from the other. This defines four portions A, B, C, D, of which the portions A and B are portions of the first waveguide 10 and the portions C and D are portions of the other waveguide 12.

Figure 1:
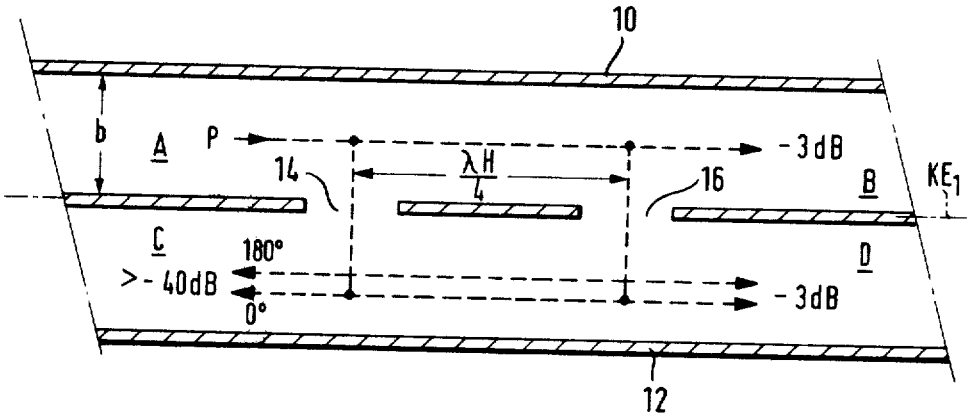
FIG. 1 PRIOR ART
FIG. 1 is a schematic longitudinal section of a 3dB coupler of hollow waveguide construction representative of the prior art.

In the coupler representing the prior art according to FIG. 1 two coupling slits 14 and 16 are disposed parallel to each other at a distance of $\lambda H/4$ in the adjacent or common wide sides of the waveguides 10, 12, extending over the entire wide side. The narrow side of the waveguides is denoted by b.

According to the energy distribution shown in FIG. 1 the entire energy P from the waveguide portion A is led past the coupling slits or windows 14, 16 to the waveguide portion B. Since the two coupling slits 14, 16 have a spacing $\lambda H/4$ in the waveguide portion D the sum of the coupled-out amounts is connected together, and in the waveguide portion C the difference thereof appears. Thus, the line portion C is decoupled and the part energies can be withdrawn via the portions BD, this energy flow being of course reversible.

Figure 2:
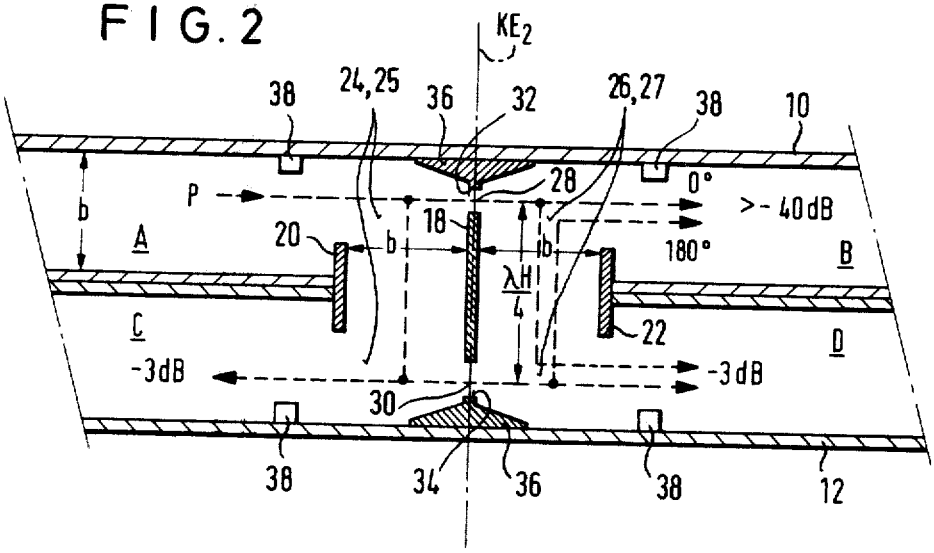
FIG. 2 is a schematic longitudinal section of a 3dB coupler of hollow waveguide construction made according to the invention.

The waveguide coupler constructed according to the invention as shown in FIG. 2 comprises a web 18 extending along the wide side and secured to the narrow sides of both waveguides and arranged in the center of a recess of the adjacent or common wide sides of the two waveguides 10, 12, which may be secured to each other by means of screws. Thus the web 18 is perpendicular to the longitudinal axes of the waveguides 11 and 12, i.e. the axes lying in the direction of extension of waveguides 11 and 12. This opening in the wide side of the waveguides is defined by conductive plates 20, 22 respectively, each lying a distance b (equal to the narrow side of the waveguides) from the conductive central web 18. Thus, waveguide portions extending perpendicularly to the waveguides 10, 12 are formed and a field deflection through 90° thus takes place at the points 24, 25 and 26, 27 respectively. The coupling plane KE2 therefore extends perpendicularly to the waveguide axis and perpendicularly to the coupling plane $KE_1$ of the known coupler according to FIG. 1. The coupling slits 28, 30 extend over the wide side of the waveguides 10, 12 between the ends of the web 18 and webs 32, 34 extending over the wide side and arranged in the coupling plane $KE_2$ inwardly on the outer wide sides. These webs merge via bevelled portions 36 into the inner wall of the waveguide.

A capacitive load in the form of narrow webs 38 disposed on the inside of the outer wide side offset from and opposite the conductive plates 20, 22 improves the forward-rearward ratio of the reflection factor. Each capacitive load 38 is preferably spaced about $0.3\lambda_H$ from the coupling plane $KE_2$.

The total energy P introduced into the waveguide portion A is led past the coupling slits 28, 30, which again have a spacing of λH/4, and divided into part energies which can be withdrawn via the waveguide portions C and D respectively whilst the portion B is decoupled, since as apparent from FIG. 2 the counterphase part energies cancel each other out here.

Figure 4:
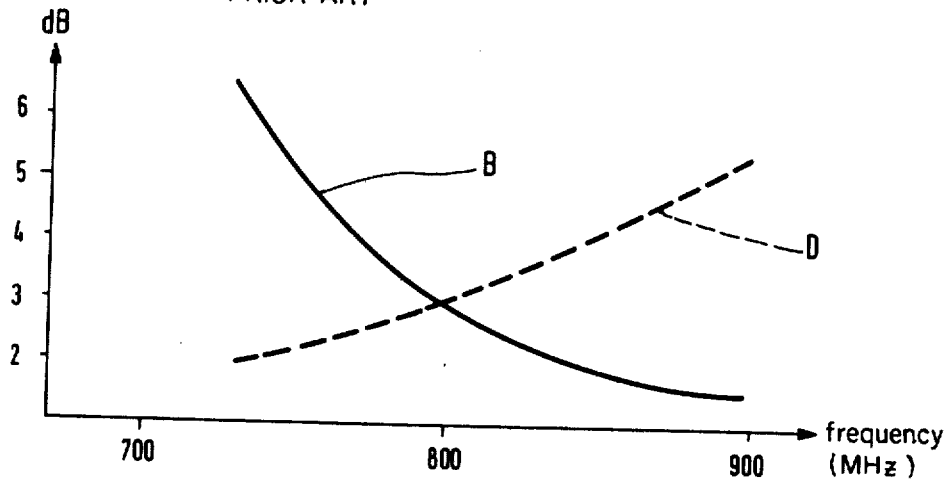
FIG. 4 PRIOR ART
FIG. 4 is a graphic illustration of the 3dB coupling behavior of the coupler of FIG. 1.
Figure 5:
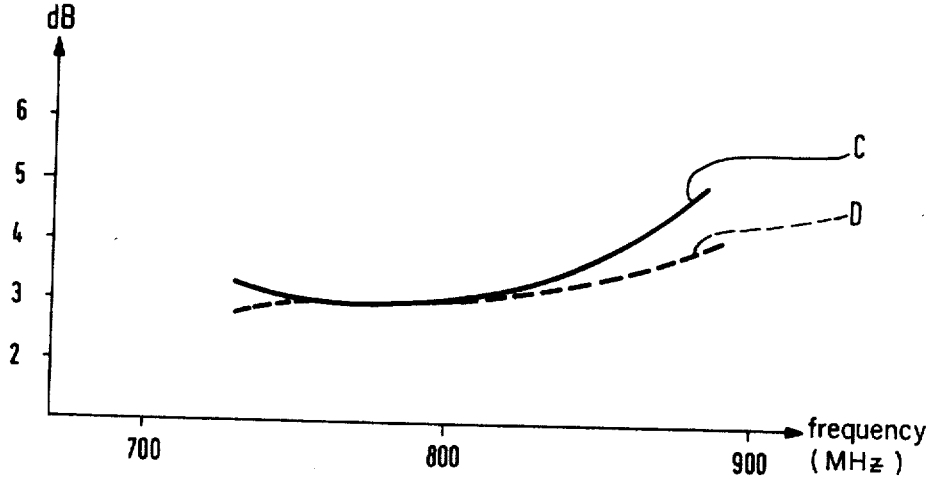
FIG. 5 is a graphic illustration of the 3dB coupling behavior of the coupler according to the invention shown in FIG. 2.

The field deflection at the points 24, 25, 26, 27 produces an inductive error which can be partially corrected by adjusting the width of the conductive plates 20, 22. FIGS. 4 and 5 show the measured electrical values compared with the known coupler. As apparent from FIG. 5 in comparison with FIG. 4 the coupler according to the invention gives satisfactory results over a much wider frequency range. FIG. 4 shows the attenuation experienced by waves propagated along directions B and D of the first and second waveguides of the conventional arrangement of FIG. 1 as a function of frequency, curve B indicating the attenuation of a wave propagated to the right in FIG. 1 in the first wave guide (indicated in FIG. 1 by B) and curve D representing the attenuation experienced by a wave propagating to the right in a second waveguide (D in FIG. 1). As can be seen, there is only a relatively narrow range, in the vicinity of 800 MHz in the example shown, in which the attenuation in both waveguides is reasonably low.

FIG. 5 shows the corresponding data for the preferred embodiment of the invention shown in FIG. 2. Curve C represents the attenuation experienced by a wave propagating to the left in FIG. 2 in the second waveguide (C in FIG. 2), while curve D of FIG. 5 illustrates the attenuation experienced by a wave propagating to the right in the second waveguide (D in FIG. 2). As can be seen from FIG. 5, there is a relatively wide range of frequencies in which the attenuation is acceptably low in both branches C and D.

Figure 3:
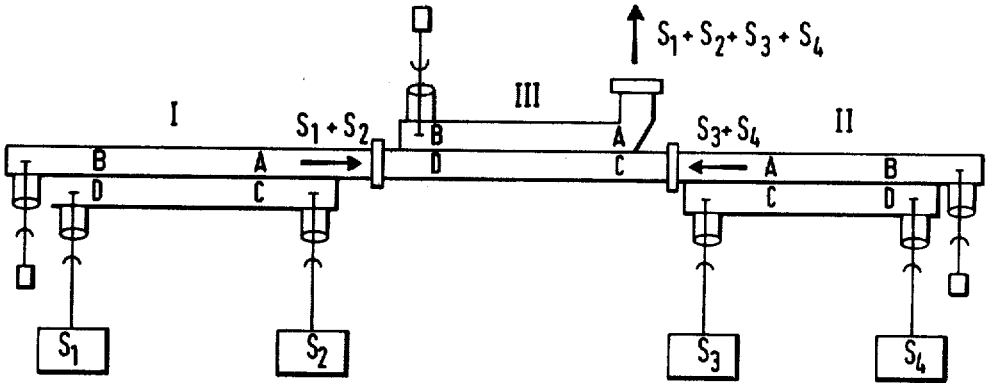
FIG. 3 is a schematic illustration of a connection of four transmitters to an antenna by means of the invention.

FIGS. 1 and 2 show the division of the total energy P into part energies. The energy direction shown is reversible. For example, the problem frequently encounted is that of connecting the energy of a plurality of transmitters to an antenna which radiates the total energy. Such an arrangement is shown fundamentally in FIG. 3. Three couplers I, II and III are connected together and constructed corresponding to the coupler according to FIG. 2. Accordingly, the transmitters $S_1$ and $S_2$ are connected to the portions D and C respectively of the coupler I, the total output of which is supplied via the portion A to the input D of the coupler III. In the same manner, the transmitters $S_3$ and $S_4$ are connected to the portions C, D of the coupler II whose output A is connected to the portion C of the coupler III so that the output A can provide to the antenna the total power $S_1+S_2+S_3+S_4$.

The webs 32, 34 (FIG. 2) are preferably made adjustable so that the width of the coupling slit or window 28, 30 is adjustable. The coupling attenuation may thereby be adjusted. Alternatively, for adjusting the coupling slits a conductive insert may be provided.

I claim:

1. A 3dB waveguide directional coupler, comprising:

first and second rectangular waveguides, each of which has a longitudinal axis and each of which extends parallel to its respective said longitudinal axis; each said wave guide comprising four side walls, said four side walls of each said waveguide including two wide side walls having a first width and two narrow side walls having a second width less than said first width; one said wide side wall of said first waveguide and one said wide side wall of said second waveguide being adjacent each other;

said adjacent wide side walls each having an aperture formed therein such that the interiors of said waveguides communicate through said aperture; and means disposed in said waveguides and cooperating with said aperture in such a manner that when energy is input from one end of said first waveguide in a direction along said first axis and toward said aperture, substantially all of said input energy is transmitted to said second waveguide via said aperture and is propagated along said second axis, substantially equal amounts of said transmitted energy being propagated along said second axis in a first longitudinal direction and along said second axis in a second longitudinal direction opposite said first longitudinal direction, the energy in each of the longitudinal directions along said second axis being substantially greater than any energy along said first axis propagating away from said aperture.

2. The directional coupler of claim 1, wherein said means is a waveguide system extending perpendicular to said longitudinal axes of said first and second waveguides and disposed in said aperture.

3. The directional coupler of claim 2, wherein said waveguide system is a rectangular waveguide system.

4. The directional coupler of claim 2, wherein said waveguide system comprises a web plate defining a coupling plane perpendicular to said axes, and first and second conducting plates parallel to said web plate; each said conducting plate being spaced from said web plate by a distance equal to said second width.

5. The directional coupler of claim 4, wherein each said wide side wall other than said adjacent wide side walls has an interior surface facing the interior of the respective said waveguide; said directional coupler further comprising capacitive load means disposed on respective said interior surfaces at locations spaced from said coupling plane by about 0.3λH, λH being the mean operating wavelength of said first and second waveguides.

6. The directional coupler of claim 4, wherein each said wide side wall other than said adjacent wide side walls has a respective interior surface facing the interior of the respective said waveguide; and said directional coupler further comprising respective additional web means disposed on each said interior surface for defining respective coupling slits between said web plate and each said additional web means.

7. The directional coupler of claim 6, further comprising beveled portions mounted on said interior surfaces, said additional web means being continuous and integral with said beveled portions.

8. The directional coupler of claim 6, wherein said coupling slits have respective mid-points and wherein said mid-points are spaced apart a distance of $\lambda H/4$, $\lambda H$ being the mean operating wavelength of said first and second waveguides.

9. The directional coupler of claim 6, wherein each said coupling slit extends along the entire width of its respective said wide side wall.

10. A coupling system for transmitters, comprising:

first, second, third and fourth transmitters;

a first directional coupler coupling said first and second transmitters, the output of said first directional coupler being equal to the sum of the outputs of said first and second transmitters;

a second directional coupler coupling said third and fourth transmitters, the output of said second directional coupler being equal to the sum of the outputs of said third and fourth transmitters;

a third directional coupler coupling said first and second directional couplers, the output of said third coupler being equal to the sum of the outputs of said first and second couplers; and each said directional coupler comprising:

(1) first and second rectangular waveguides, each of which has a longitudinal axis and each of which extends parallel to its respective said longitudinal axis; each said wave guide comprising four side walls, said four side walls of each said waveguide including two wide side walls having a first width and two narrow side walls having a second width less than said first width; one said wide side wall of said first waveguide and one said wide side wall of said second waveguide being immediately adjacent each other;

(2) said adjacent wide side walls each having an aperture formed therein such that the interiors of said waveguides communicate therethrough; and (3) means disposed in said waveguides and cooperating with said aperture in such a manner that when energy is input from one end of said first waveguide in a direction along said first axis and toward said aperture, substantially all of said input energy is transmitted to said second waveguide via said aperture and is propagated along said second axis, substantially equal amounts of said transmitted energy being propagated along said second axis in a first longitudinal direction and along said second axis in a second longitudinal direction opposite said first longitudinal direction, the energy in each of the longitudinal directions along said second axis being substantially greater than any energy along said first axis propagating away from said aperture.

11. A 3dB waveguide directional coupler, comprising:

first and second rectangular waveguides each of which has a longitudinal axis and each of which extends parallel to its respective said longitudinal axis; each said waveguide comprising four side walls, said four side walls of each said waveguide including two wide side walls having a first width and two narrow side walls having a second width less than said first width; one said wide side wall of said first waveguide and one said wide side wall of said second waveguide being adjacent each other;

said adjacent wide side walls each having an aperture formed therein such that the interiors of said waveguides communicate through said aperture;

means disposed in said waveguides and cooperating with said aperture in such a manner that when energy is input from one end of said first waveguide in a direction along said first axis and toward said aperture, substantially all of said input energy is transmitted to said second waveguide via said aperture and is propagated along said second axis, a substantial part of said transmitted energy being propagated along said second axis in a first longitudinal direction and a substantial part of said transmitted energy being propagated along said second axis in a second longitudinal direction opposite said first longitudinal direction; said means comprising a waveguide system extending perpendicular to said longitudinal axes of said first and second waveguides and disposed in said aperture, said waveguide system comprising a web plate defining a coupling plane perpendicular to said axes, and further comprising first and second conducting plates parallel to said web plate; each said conducting plate being spaced from said web plate by a distance equal to said second width.

* * * * *